US011088484B2

(12) United States Patent
Kurita

(10) Patent No.: US 11,088,484 B2
(45) Date of Patent: Aug. 10, 2021

(54) CONTACT MEMBER

(71) Applicant: KITAGAWA INDUSTRIES CO., LTD., Inazawa (JP)

(72) Inventor: Tomohisa Kurita, Kasugai (JP)

(73) Assignee: KITAGAWA INDUSTRIES CO., LTD., Inazawa (JP)

( * ) Notice: Subject to any disclaimer, the term of this patent is extended or adjusted under 35 U.S.C. 154(b) by 0 days.

(21) Appl. No.: 16/858,149

(22) Filed: Apr. 24, 2020

(65) Prior Publication Data

US 2020/0343663 A1 Oct. 29, 2020

(30) Foreign Application Priority Data

Apr. 25, 2019 (JP) ..... JP2019-084045

(51) Int. Cl.
*H01R 13/24* (2006.01)

(52) U.S. Cl.
CPC ..... *H01R 13/24* (2013.01)

(58) Field of Classification Search
CPC ..... H01R 13/2442; H01R 12/57; H01R 13/24
USPC ..... 439/66, 862
See application file for complete search history.

(56) References Cited

U.S. PATENT DOCUMENTS 4,431,252 A * 2/1984 Cairns ..... H01R 23/70 439/862
6,142,790 A * 11/2000 Niitsu ..... H01R 12/592 439/495
6,315,621 B1 * 11/2001 Natori ..... H01R 13/2428 439/862
6,589,082 B2 * 7/2003 Harasawa ..... H01R 13/2442 439/595
6,604,950 B2 * 8/2003 Maldonado ..... H05K 7/1069 439/591
7,131,875 B2 * 11/2006 Kodaira ..... H01R 13/2442 439/862
7,429,200 B2 * 9/2008 Lee ..... H01R 13/2442 439/862
8,070,498 B2 * 12/2011 Shen ..... H01R 12/714 439/66

(Continued)

FOREIGN PATENT DOCUMENTS

JP 5124789 1/2013

*Primary Examiner* — Gary F Paumen
(74) *Attorney, Agent, or Firm* — Steven J. Grossman; Grossman, Tucker, Perreault & Pfleger

(57) ABSTRACT

A contact member for which downsizing beyond conventional products is feasible is provided. The contact member includes a base portion, a contact portion, and a spring portion. The spring portion includes a first extension portion, a second extension portion, a third extension portion, and a fourth extension portion. The first extension portion is bent from a rear end of the base portion and extends upward. The second extension portion is bent from an upper end of the first extension portion and extends forward, and its upper surface is made to be a sucked surface that is capable of being attracted to a suction nozzle of an automatic mounting machine. The third extension portion is bent from a front end of the second extension portion and extends forward obliquely downward. The fourth extension portion is bent from a front end of the third extension portion, extends upward obliquely rearward, and is provided with the contact portion on a distal end side in its extension direction.

8 Claims, 7 Drawing Sheets

(56) References Cited

U.S. PATENT DOCUMENTS

| | | | | |
|---|---|---|---|---|
| 8,956,194 | B2 * | 2/2015 | Xie | H01R 13/516<br>439/862 |
| 8,974,257 | B1 * | 3/2015 | Xie | H01R 13/2442<br>439/862 |
| 2006/0276085 | A1 * | 12/2006 | Ma | H01R 13/2464<br>439/862 |
| 2011/0177718 | A1 * | 7/2011 | Shen | H01R 12/714<br>439/625 |

* cited by examiner

CONTACT MEMBER

CROSS-REFERENCE TO RELATED APPLICATION

This application is based on and claims the benefit of priority of the prior Japanese Patent Application No. 2019-084045, filed on Apr. 25, 2019, the entire contents of which are incorporated herein by reference.

BACKGROUND OF THE INVENTION

1. Field of the Invention

The present disclosure relates to a contact member.

2. Description of the Related Art

Japanese Patent No. 5124789 (JP-5124789) discloses a surface mount contact (equivalent to a contact member in the present disclosure). The surface mount contact described in JP-5124789 is a member that is mounted on a ground pattern of a printed circuit board and makes it conductive between the printed circuit board and a conductive member such as a chassis or the like.

As the devices become more multi-functional and downsized, the densification of board mount components has been advanced at an accelerated pace. For this reason, downsizing has also been desired for an individual board mount component. The surface mount contact shown above is no exception either and further downsizing has been desired.

One aspect of the present disclosure is to provide a contact member for which downsizing beyond conventional products is feasible.

BRIEF SUMMARY OF THE INVENTION

A contact member in one aspect of the present disclosure is made up of sheet metal, and is structured to electrically connect a first member and a second member when surface-mounted on the first member and sandwiched between the first member and the second member. The contact member includes a base portion, a contact portion, and a spring portion. The base portion has a joining surface that is soldered to the first member when the contact member is used. The contact portion comes into contact with the second member when the contact member is used. The spring portion extends from one end of the base portion, is provided with the contact portion on a distal end side in an extension direction thereof, and makes the contact portion pressure-contact with the second member by elastically deforming when the contact portion comes into contact with the second member. By defining, in a three-dimensional Cartesian coordinate system, an x-axis positive direction is a right side, an x-axis negative direction is a left side, a y-axis positive direction is a rear side, a y-axis negative direction is a front side, a z-axis positive direction is an upper side, and a z-axis negative direction is a lower side, and in a state where the joining surface is directed toward the lower side and the one end of the base portion is directed toward the rear side, the spring portion includes a first extension portion, a second extension portion, a third extension portion, and a fourth extension portion. The first extension portion is bent from a rear end of the base portion and extends toward the upper side. The second extension portion is bent from an upper end of the first extension portion and extends toward the front side, and an upper surface thereof is made to be a sucked surface that is capable of being attracted to a suction nozzle of an automatic mounting machine. The third extension portion is bent from a front end of the second extension portion and extends obliquely downward toward the front side. The fourth extension portion is bent from a front end of the third extension portion, extends obliquely rearward toward the upper side, and is provided with the contact portion on a distal end side in an extension direction thereof.

However, the extension direction of the first extension portion is not limited to the upper side in a strict sense and may be an extension direction slightly inclined with respect to the z-axis direction. The extension direction of the second extension portion is not limited to the front side in a strict sense and may be an extension direction slightly inclined with respect to the y-axis direction.

According to the contact member thus structured, the spring portion is of a structure provided with the first extension portion, the second extension portion, the third extension portion, and the fourth extension portion as in the foregoing. As a result, the structure that is present between the base portion having the joining surface and the second extension portion constituting the sucked surface can be made in a structure for which the dimension in the y-axis direction is smaller than a "first folding portion" referred to in JP-5124789 shown above, and the dimension of the connection member in the y-axis direction can be reduced by that amount. In addition, the extension direction of the third extension portion is arranged so as to bend from the front end of the second extension portion and extend obliquely downward toward the front side. As a result, the dimension of the third extension portion in the y-axis direction can be made smaller than in the case where, as in the technique described in JP-5124789, a portion having the sucked surface and a portion further extending from the relevant portion extend along the same direction, and the dimension of the connection member in the y-axis direction can be reduced by that amount. Owing to these structures, if it is the contact member shown above, it is possible to achieve downsizing of the contact member beyond the technique described in JP-5124789.

In addition, the contact member of the present disclosure may further include the following structures.

(A) For example, the contact member may include a first hook portion, a second hook portion, a first sidewall portion, and a second sidewall portion. The first hook portion projects toward the left side from the third extension portion. The second hook portion projects toward the right side from the third extension portion. The first sidewall portion is bent from the left end of the base portion and extends toward the upper side. The second sidewall portion is bent from the right end of the base portion and extends toward the upper side. The contact member may be structured, when the third extension portion is displaced as external force acts on the spring portion, such that displacement of the third extension portion is restrained by establishment of at least one of states out of a state where the first hook portion comes into contact with the first sidewall portion and a state where the second hook portion comes into contact with the second sidewall portion.

According to the contact member thus structured, even when external force acts on the spring portion, because the first hook portion, the first sidewall portion, the second hook portion, and the second sidewall portion are provided, the displacement of the third extension portion is restrained. As a result, it is possible to restrain unexpected deformation from arising in the spring portion. In addition, because the first hook portion and the second hook portion are provided on the third extension portion structured as in the foregoing, it is possible to arrange the first hook portion and the second hook portion at positions, in the z-axis direction, on the lower side relative to the second extension portion on which the sucked surface is provided. As a result, it is possible to arrange the upper ends of the first sidewall portion and the second sidewall portion further on the lower side relative to the technique described in JP-5124789 for which hook portions are arranged at the same height as a portion on which the sucked surface is provided. Thus, it is possible to reduce the possibility that, when the suction nozzle of the automatic mounting machine attracts the sucked surface, the tip of the suction nozzle catches on the upper ends of the first sidewall portion and the second sidewall portion relative to the case where the upper ends of the first sidewall portion and the second sidewall portion are arranged further on the upper side.

(B) For example, the contact member may be structured, when the third extension portion is displaced obliquely rearward toward the upper side as external force acts on the spring portion, such that displacement of the third extension portion obliquely rearward toward the upper side is restrained by establishment of at least one of states out of a state where the first hook portion comes into contact with the first sidewall portion and a state where the second hook portion comes into contact with the second sidewall portion.

According to the contact member thus structured, the first hook portion and the second hook portion come into contact with the first sidewall portion and the second sidewall portion on the respective end face sides of the sheet that constitutes them. As a result, the first hook portion and the second hook portion are not likely to be bent relative to the case where the first hook portion and the second hook portion come into contact with the first sidewall portion and the second sidewall portion on one sheet surface side of either the front or rear of the sheet. Thus, by the amount that the first hook portion and the second hook portion are not likely to be bent, it is possible to make the sheet thickness thinner and that contributes to downsizing of the contact member.

(C) For example, the contact portion may be bent from an upper end of the fourth extension portion toward the rear side and extend toward the lower side, and be structured to come into contact with the second member at an outer circumferential surface of a bent portion thereof.

According to the contact member thus structured, the contact portion comes into contact with the second member at the outer circumferential surface of the portion where the sheet has been bent. Thus, even if the contact portion is slightly displaced in a direction accompanying a slight rotation when the spring portion is deformed, it is possible to maintain a state where the contact portion is in contact with the second member at the bent outer circumferential surface, and it is possible to stably maintain the state of electrical connection between the contact portion and the second member.

(D) For example, the contact portion may be provided at a position on the front side relative to the second extension portion in the y-axis direction.

According to the contact member thus structured, the contact portion and the second extension portion are arranged at positions not overlapping in the y-axis direction (that is, front-and-rear direction) when viewed from above. As a result, unlike the case where the contact portion and the second extension portion are arranged at overlapping positions in the y-axis direction, it is possible to effectively use the entire upper surface of the second extension portion as the sucked surface. Thus, because the size of the second extension portion can be minimized for ensuring the sucked surface of a predetermined dimension, relative to the case where the contact portion and the second extension portion are arranged at overlapping positions in the y-axis direction, it is possible to downsize the second extension portion, and consequently, it is possible to downsize the entire contact member.

BRIEF DESCRIPTION OF THE DRAWINGS

The present invention will be described hereinafter with reference to the annexed drawings. It is to be noted that the drawings are shown for the purpose of illustrating the technical concepts of the present invention or embodiments thereof, wherein.

DETAILED DESCRIPTION OF THE INVENTION

The contact members shown above will be described with exemplary embodiments.

(1) First Embodiment

Figure 3B:
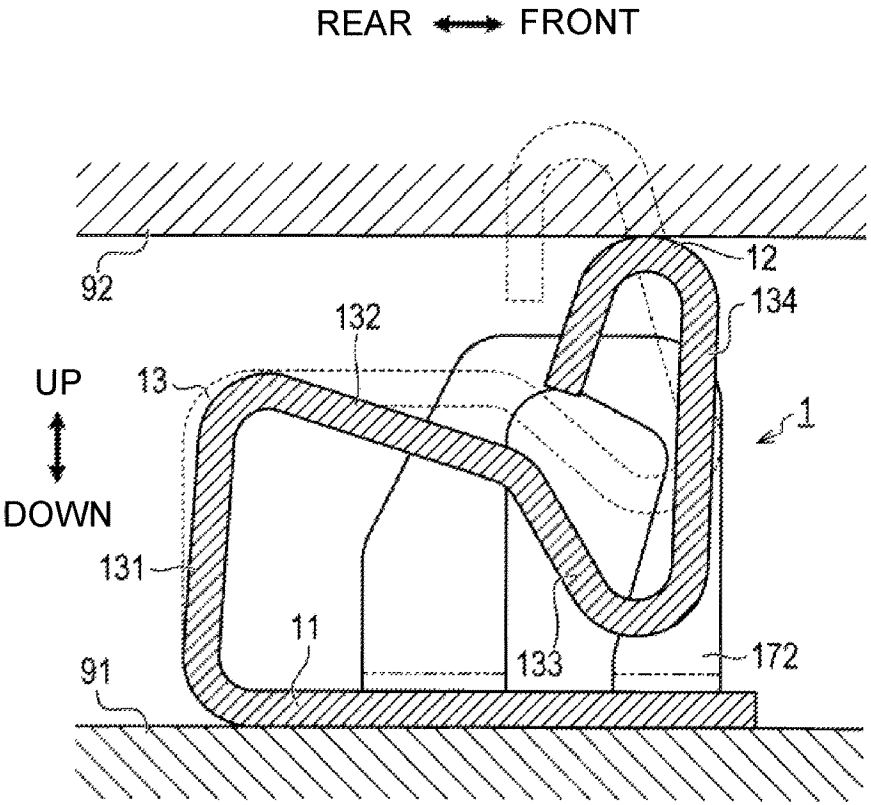
FIG. 3B is a cross-sectional view showing the position and the shape of the spring portion in a state where the second member is in contact with the contact member.
Figure 3A:
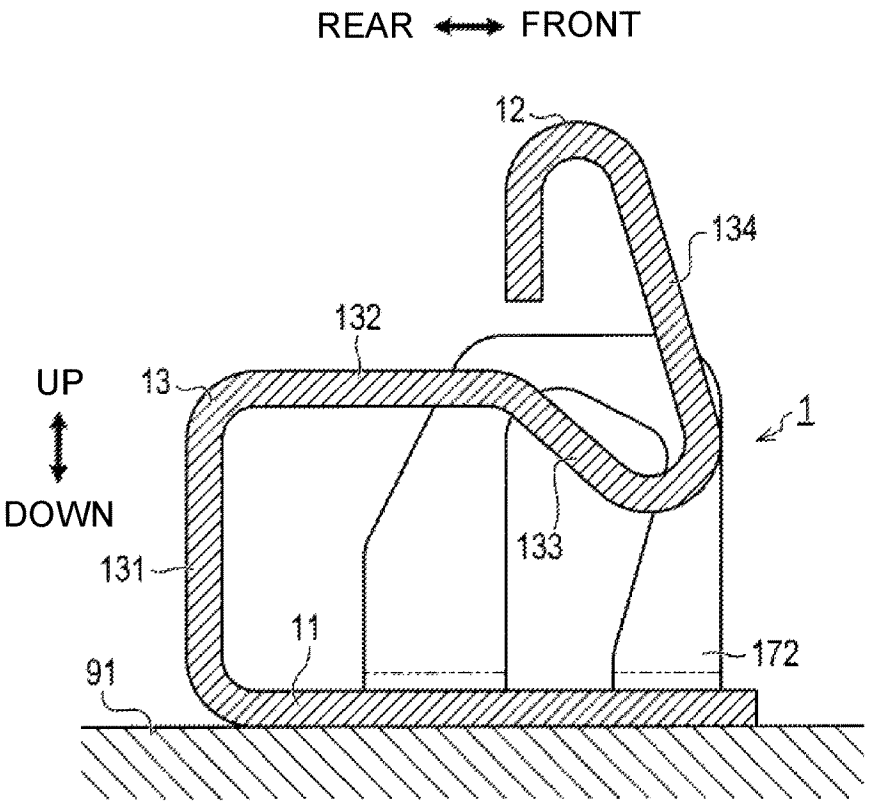
FIG. 3A is a cross-sectional view showing the position and the shape of a spring portion in a state where a second member is not in contact with the contact member.

As shown in FIG. 1A, FIG. 1B, FIG. 2A, FIG. 2B, FIG. 2C, FIG. 2D, FIG. 2E, and FIG. 2F, a contact member 1 is provided with a base portion 11, a contact portion 12, a spring portion 13, a first hook portion 151, a second hook portion 152, a first sidewall portion 171, and a second sidewall portion 172. The contact member 1 is made up of sheet metal (in the case of the first embodiment, a beryllium copper sheet of 0.1 mm thickness). The contact member 1, as shown in FIG. 3A, is surface-mounted on a first member 91 and, as shown in FIG. 3B, when sandwiched between the first member 91 and a second member 92, the contact member 1 electrically connects the first member 91 and the second member 92. An example of the first member 91 includes an electronic circuit board, for example. An example of the second member 92 includes a metal panel or the like that constitutes a housing of a device, for example.

The base portion 11 has a joining surface 21. This joining surface 21 is soldered to the first member 91 (see FIG. 3A and FIG. 3B) when the contact member 1 is used. The contact portion 12 comes into contact with the second member 92 (see FIG. 3B) when the contact member 1 is used. The spring portion 13 extends from one end of the base portion 11 and is provided with the contact portion 12 on the distal end side in its extension direction. When the contact portion 12 comes into contact with the second member 92, the spring portion 13 elastically deforms, so that the spring portion 13 makes the contact portion 12 pressure-contact with the second member 92.

Figure 1A:
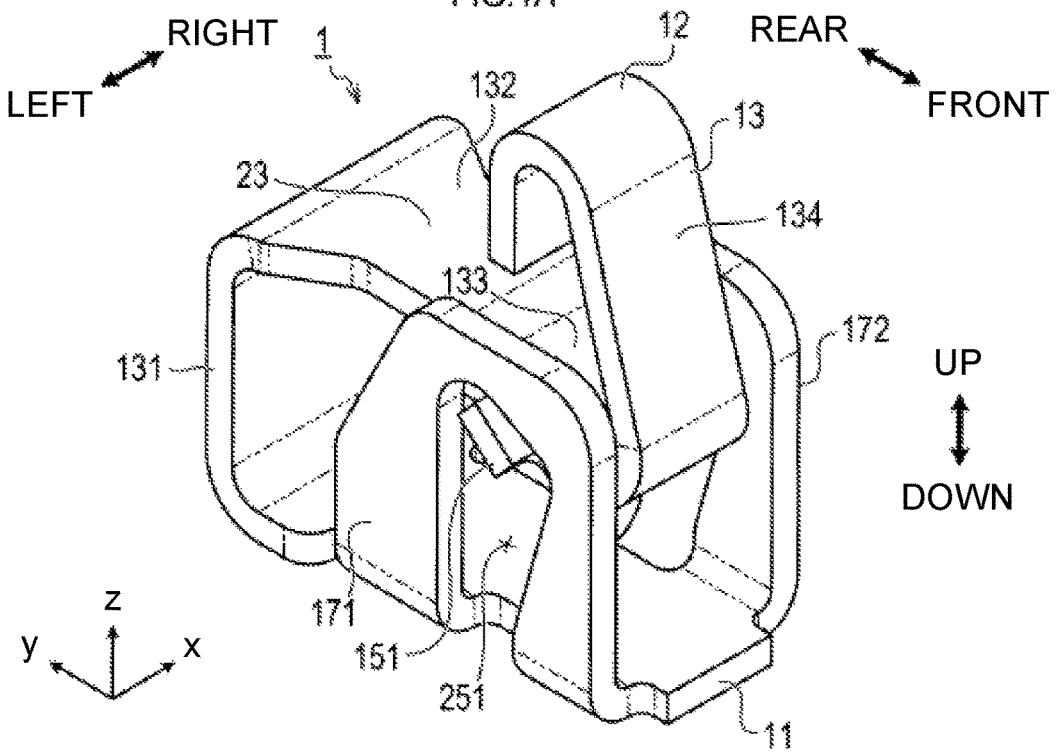
FIG. 1A is a perspective view of a contact member according to a first embodiment viewed from front left above.
Figure 1B:
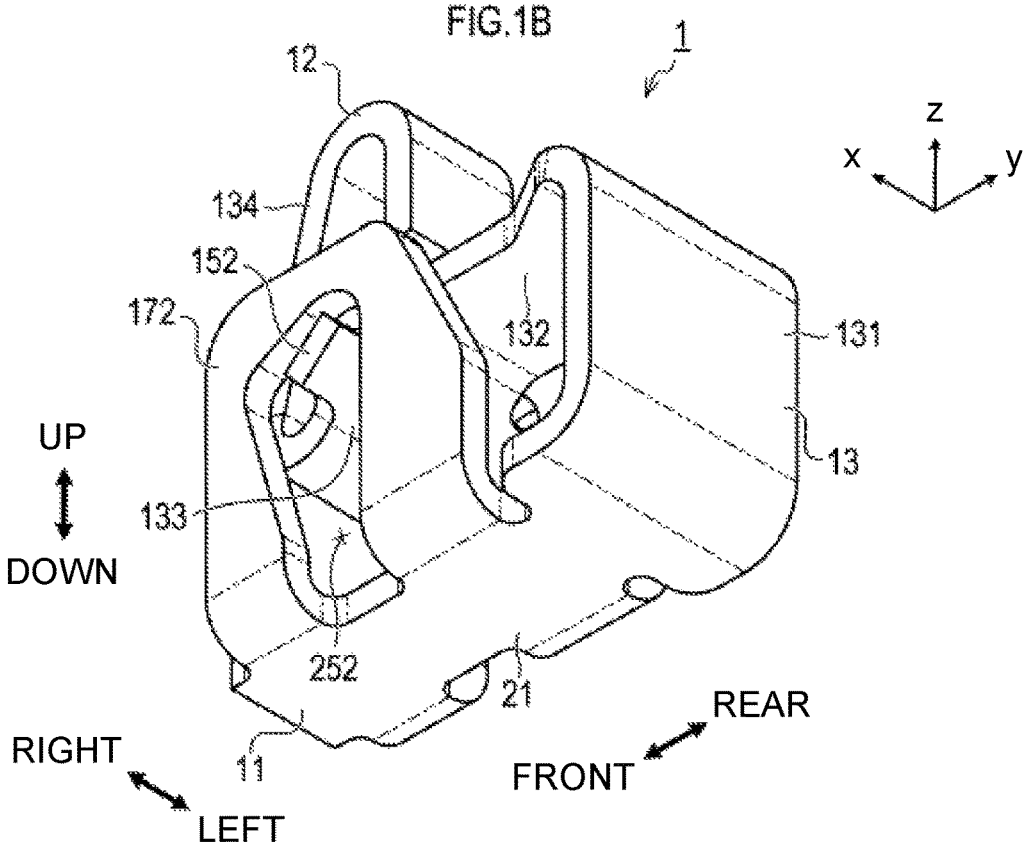
FIG. 1B is a perspective view of the contact member of the first embodiment viewed from rear right below.
Figure 2E:
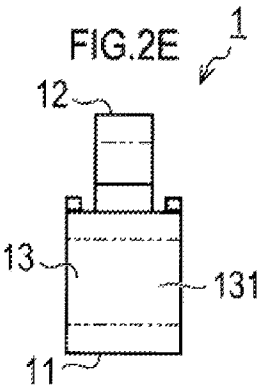
FIG. 2E is a rear view of the contact member of the first embodiment.
Figure 2D:
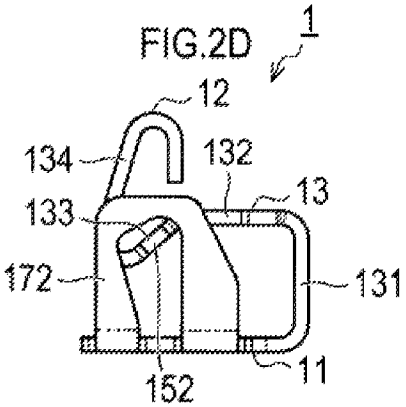
FIG. 2D is a right side view of the contact member of the first embodiment.
Figure 2A:
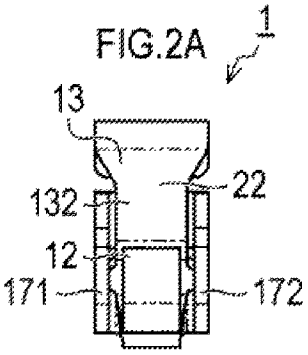
FIG. 2A is a plan view of the contact member of the first embodiment.
Figure 2C:
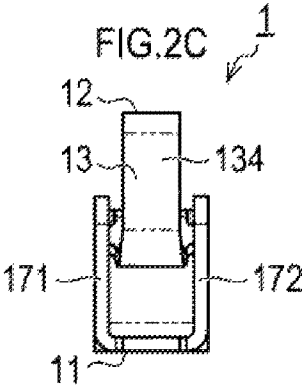
FIG. 2C is a front view of the contact member of the first embodiment.
Figure 2F:
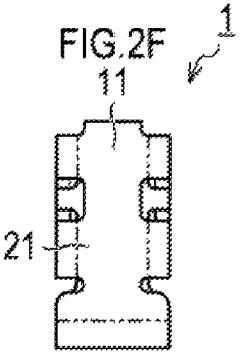
FIG. 2F is a bottom view of the contact member of the first embodiment.
Figure 2B:
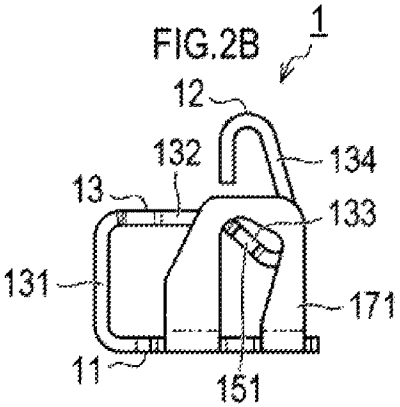
FIG. 2B is a left side view of the contact member of the first embodiment.

In the following description, as shown in FIG. 1A and FIG. 1B, it is defined that, in a three-dimensional Cartesian coordinate system, an x-axis positive direction is a right side, an x-axis negative direction is a left side, a y-axis positive direction is a rear side, a y-axis negative direction is a front side, a z-axis positive direction is an upper side, and a z-axis negative direction is a lower side. In addition, in the foregoing three-dimensional Cartesian coordinate system, by assuming a state where the foregoing joining surface 21 is directed toward the lower side and the one end of the base portion 11 is directed toward the rear side, the relative position, the shape, or the like of each portion that the contact member 1 is provided with will be described. However, it is discretionary to determine the direction to which each portion that the contact member 1 is provided with is oriented when the contact member 1 is used. For example, it may be used in a state where the foregoing joining surface 21 is oriented in a direction other than the lower side.

The spring portion 13 includes a first extension portion 131, a second extension portion 132, a third extension portion 133, and a fourth extension portion 134. The first extension portion 131 is bent from the rear end of the base portion 11 and extends toward the upper side. However, the extension direction of the first extension portion 131 is not limited to the upper side in a strict sense, and may be an extension direction slightly inclined (for example, within a range of approximately +/−5 degrees) with respect to the z-axis direction. That is, if the extension direction of the first extension portion 131 and the joining surface 21 are roughly perpendicular, they may be not necessary to be perpendicular in a strict sense.

The second extension portion 132 is bent from the upper end of the first extension portion 131 and extends toward the front side. However, the extension direction of the second extension portion 132 is not limited to the front side in a strict sense, and may be an extension direction slightly inclined (for example, within a range of approximately +/−5 degrees) with respect to the y-axis direction. That is, if the extension direction of the second extension portion 132 and the joining surface 21 are roughly parallel, they may be not necessary to be in parallel in a strict sense. The upper surface of the second extension portion 132 is made to be a sucked surface 23 that is capable of being attracted to a suction nozzle of an automatic mounting machine.

The third extension portion 133 is bent from the front end of the second extension portion 132 and extends obliquely downward toward the front side. In the first embodiment, the extension direction of the third extension portion 133 is a direction that forms an inclination of approximately 42 degrees between the joining surface 21 and the third extension portion 133. The fourth extension portion 134 is bent from the front end of the third extension portion 133 and extends obliquely rearward toward the upper side. In the first embodiment, the extension direction of the fourth extension portion 134 is a direction that forms an inclination of approximately 74 degrees between the joining surface 21 and the fourth extension portion 134. The fourth extension portion 134 is provided with the contact portion 12 on the distal end side in its extension direction.

The contact portion 12 is bent from the upper end of the fourth extension portion 134 toward the rear side and extends toward the lower side. The contact portion 12 is, as shown in FIG. 3B, structured to come into contact with the second member 92 at the outer circumferential surface of the bent portion. The contact portion 12 is provided at a position on the front side relative to the second extension portion 132 in the y-axis direction.

The first hook portion 151 projects toward the left side from the third extension portion 133. The second hook portion 152 projects toward the right side from the third extension portion 133. The first sidewall portion 171 is bent from the left end of the base portion 11 and extends toward the upper side. The second sidewall portion 172 is bent from the right end of the base portion 11 and extends toward the upper side. In the first embodiment, the first sidewall portion 171 is provided with a first opening 251. The second sidewall portion 172 is provided with a second opening 252. The first hook portion 151 is arranged at a position to get into the inside of the first opening 251. The second hook portion 152 is arranged at a position to get into the inside of the first opening 251.

Figure 4B:
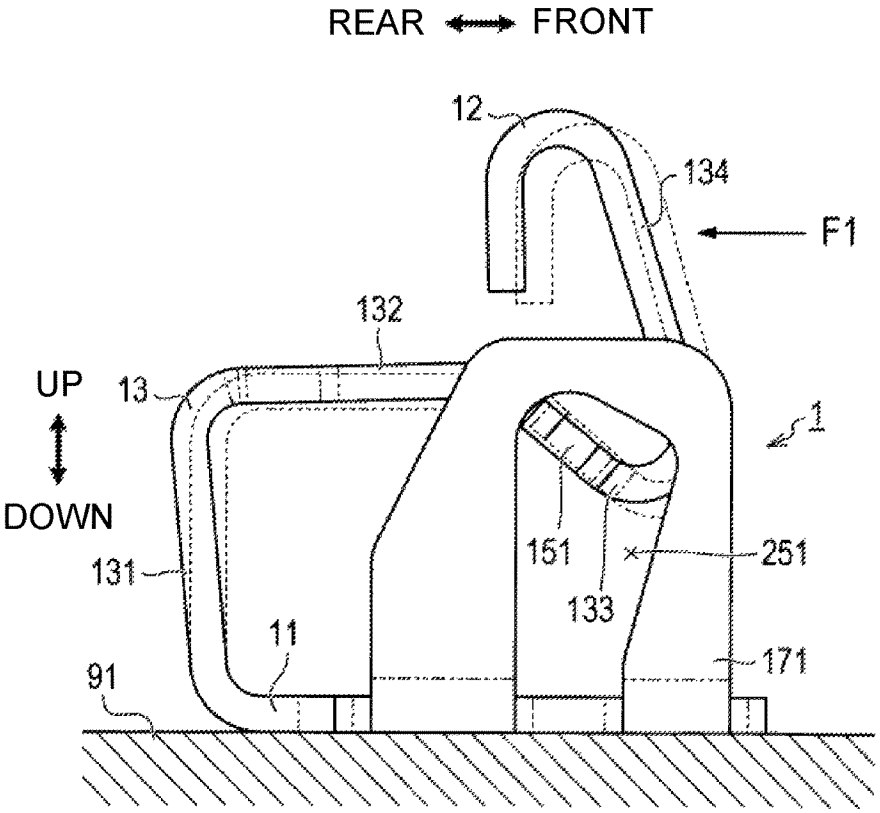
FIG. 4B is a right side view showing the position of the first hook portion in a state where the external force F1 acts on the spring portion.
Figure 4A:
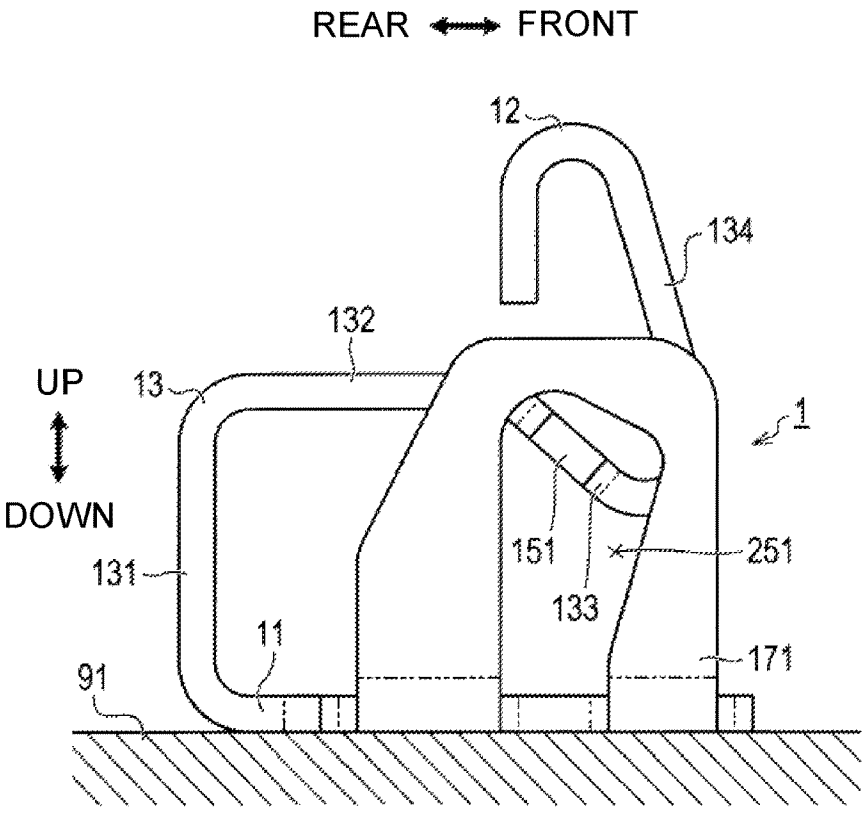
FIG. 4A is a right side view showing the position of a first hook portion in a state where external force F1 does not act on the spring portion.

When the third extension portion 133 is displaced as external force acts on the spring portion 13, the first hook portion 151 comes into contact with the first sidewall portion 171 in the inside of the first opening 251. The second hook portion 152 comes into contact with the second sidewall portion 172 in the inside of the second opening 252. As a result, the displacement of the third extension portion 133 is restrained and the spring portion 13 can be restrained from deforming by being displaced excessively. In particular, in the first embodiment, as shown in FIG. 4A and FIG. 4B, for example, due to external force F1 that acts on the spring portion 13 or the like, when the third extension portion 133 is displaced obliquely rearward toward the upper side, the first hook portion 151 comes into contact with the first sidewall portion 171 on the end face side of the sheet. In addition, the second hook portion 152 comes into contact with the second sidewall portion 172 on the end face side of the sheet. As a result, the third extension portion 133 is restrained from displacing obliquely rearward toward the upper side and the spring portion 13 can be restrained from deforming in a direction in which the contact portion 12 lifts toward the upper side.

Figure 5B:
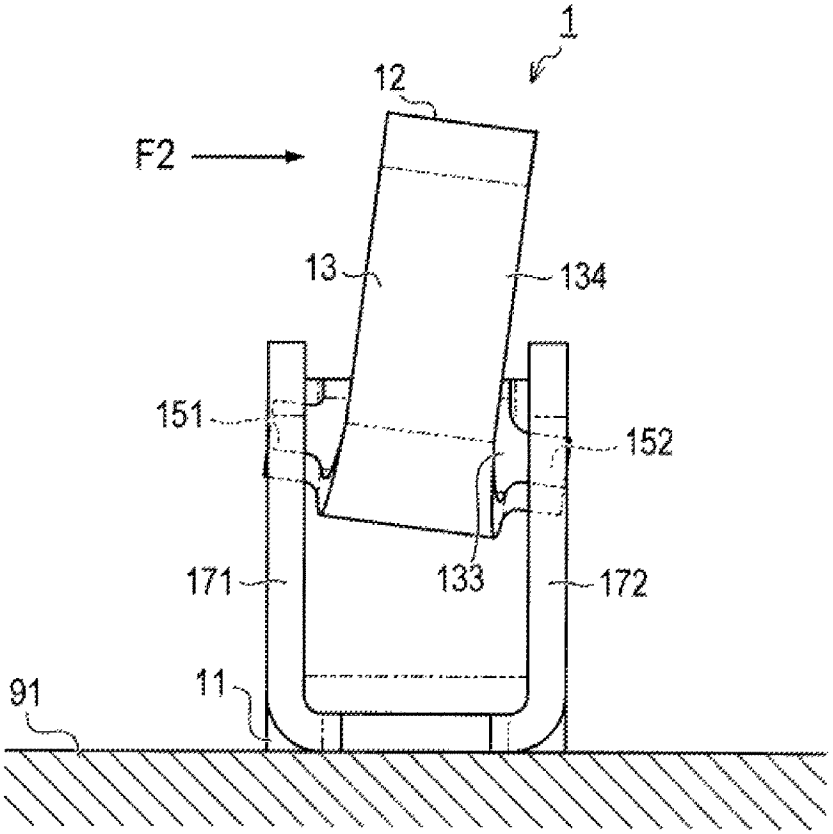
FIG. 5B is a front view showing the positions of the first hook portion and the second hook portion in a state where the external force F2 acts on the spring portion.
Figure 5A:
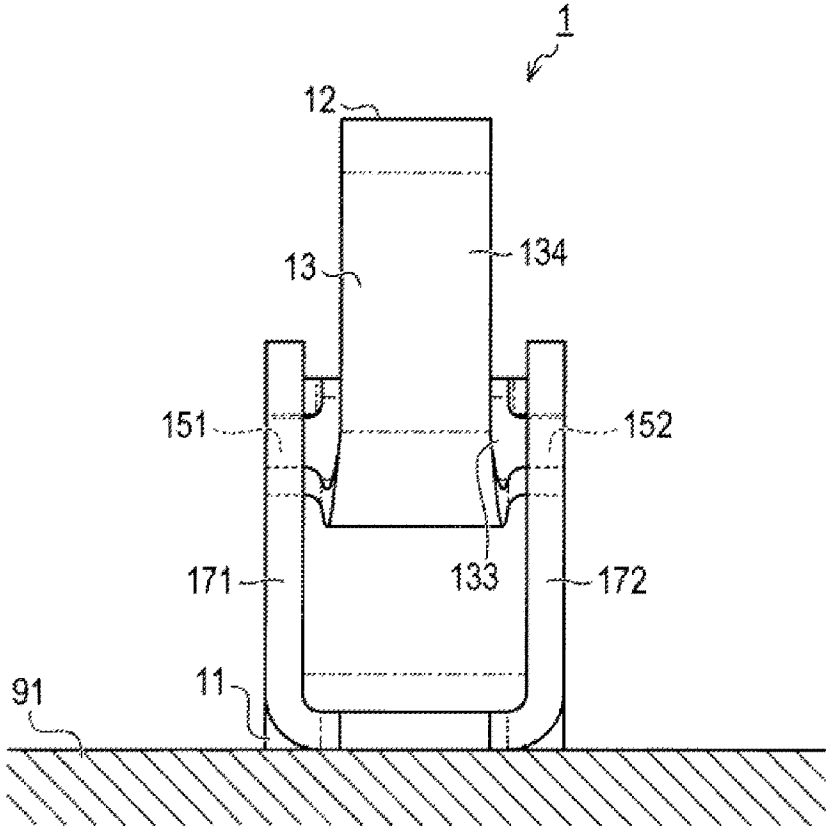
FIG. 5A is a front view showing the positions of the first hook portion and a second hook portion in a state where external force F2 does not act on the spring portion.
Figure 6A:
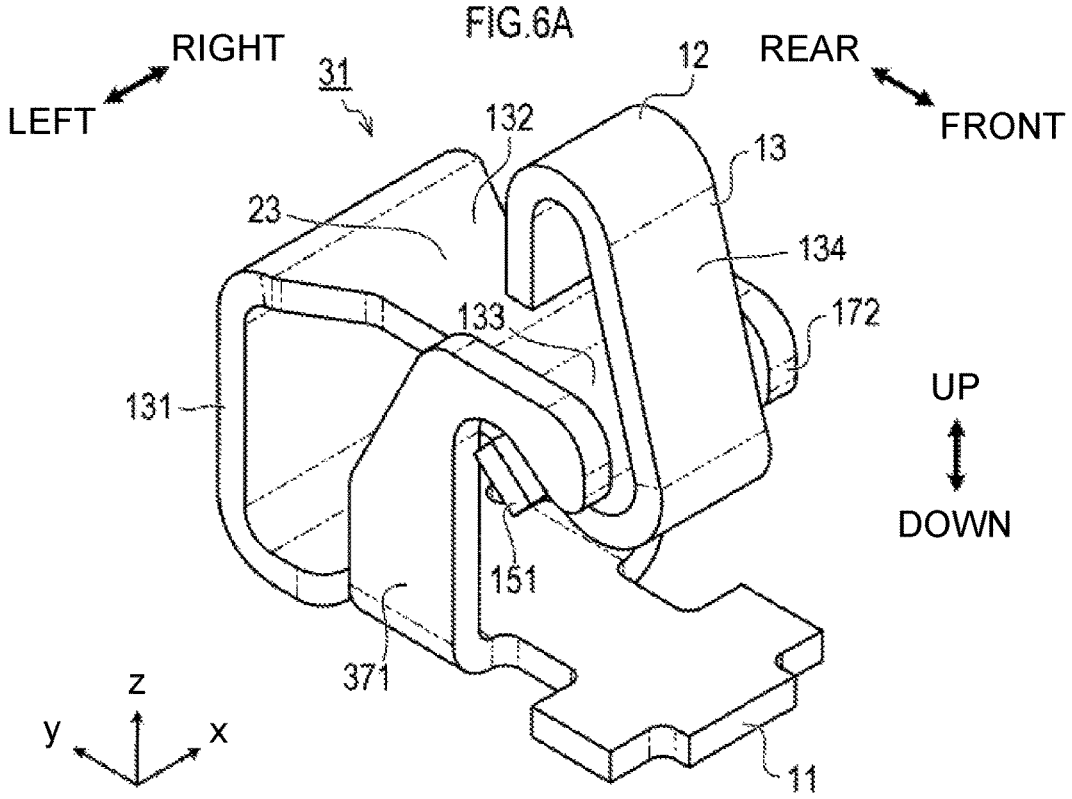
FIG. 6A is a perspective view of a contact member according to a second embodiment viewed from front left above.
Figure 6B:
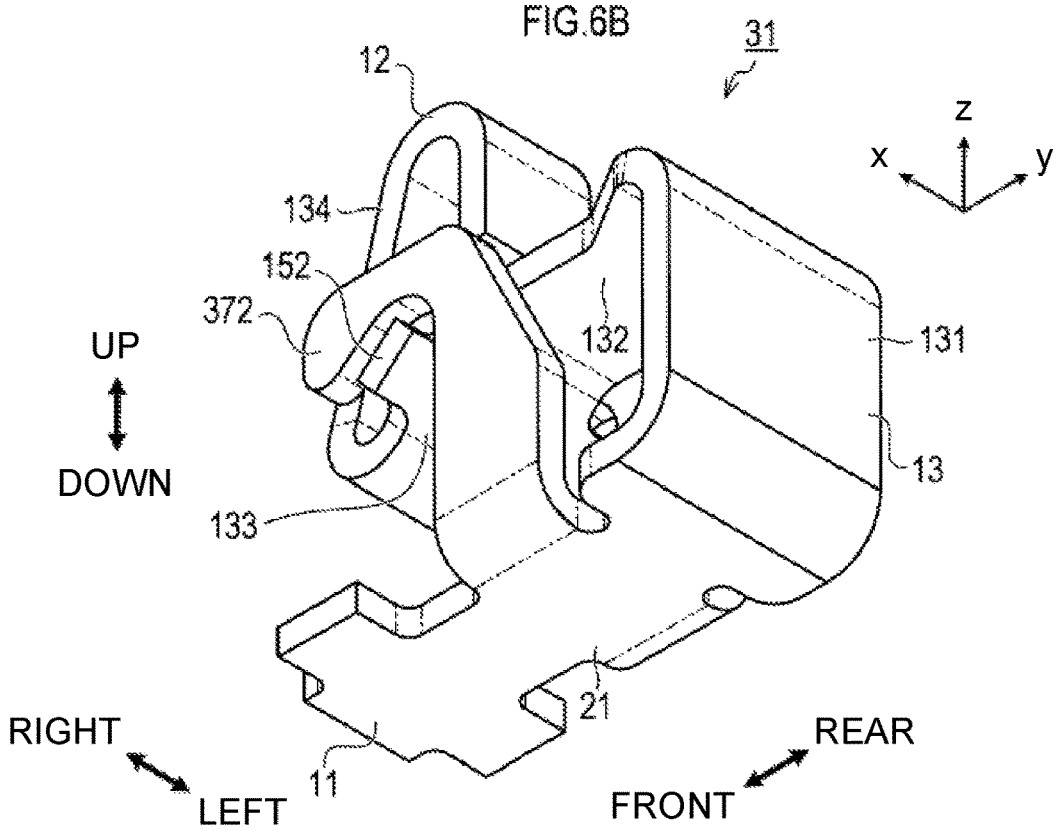
FIG. 6B is a perspective view of the contact member of the second embodiment viewed from rear right below.
Figure 7E:
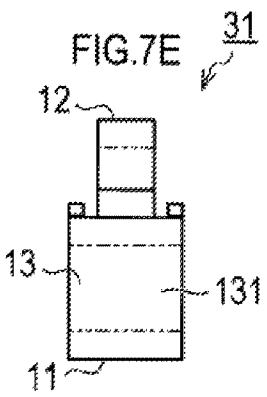
FIG. 7E is a rear view of the contact member of the second embodiment.
Figure 7D:
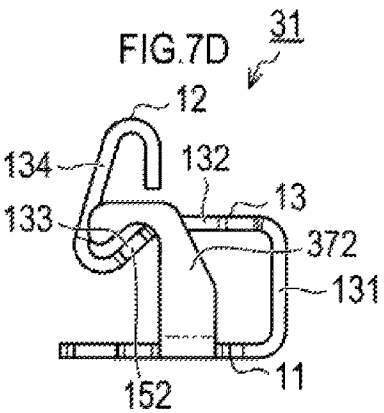
FIG. 7D is a right side view of the contact member of the second embodiment.
Figure 7A:
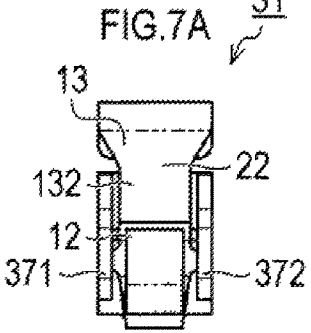
FIG. 7A is a plan view of the contact member of the second embodiment.
Figure 7C:
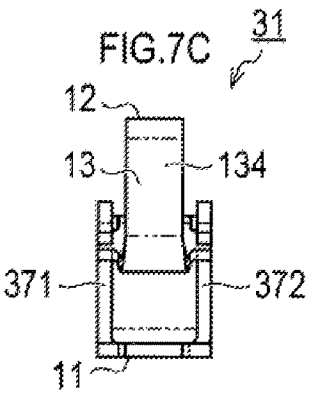
FIG. 7C is a front view of the contact member of the second embodiment.
Figure 7F:
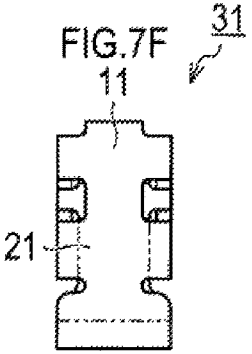
FIG. 7F is a bottom view of the contact member of the second embodiment.
Figure 7B:
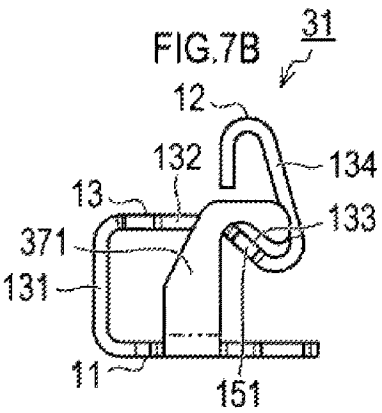
FIG. 7B is a left side view of the contact member of the second embodiment.

In addition, in the first embodiment, as shown in FIG. 5A and FIG. 5B, for example, due to external force F2 that acts on the spring portion 13 and the like, when the fourth extension portion 134 is displaced in a direction inclined toward the right side in front view, the first hook portion 151 comes into contact with the first sidewall portion 171 at an end portion located obliquely rearward toward the upper side. As a result, the fourth extension portion 134 can be restrained from further inclining and the spring portion 13 can be restrained from deforming.

According to the contact member 1 thus structured, the spring portion 13 is of a structure provided with the first extension portion 131, the second extension portion 132, the third extension portion 133, and the fourth extension portion 134 as in the foregoing. As a result, the structure that is present between the base portion 11 having the joining surface 21 and the second extension portion 132 constituting the sucked surface 23 can be made in a structure for which the dimension in the y-axis direction is smaller than a "first folding portion" referred to in JP-5124789 shown above, and the dimension of the connection member in the y-axis direction can be reduced by that amount. In addition, the extension direction of the third extension portion 133 is arranged so as to bend from the front end of the second extension portion 132 and extend obliquely downward toward the front side. As a result, the dimension of the third extension portion 133 in the y-axis direction can be made smaller than in the case where, as in the technique described in JP-5124789, a portion having the sucked surface 23 and a portion further extending from the relevant portion extend along the same direction, and the dimension of the connection member in the y-axis direction can be reduced by that amount. Owing to these structures, if it is the contact member 1 shown above, it is possible to achieve downsizing of the contact member 1 beyond the technique described in JP-5124789.

In the first embodiment, the spring portion 13 is of a structure provided with the first extension portion 131, the second extension portion 132, the third extension portion 133, and the fourth extension portion 134 as in the foregoing. As a result, as shown in FIG. 3A and FIG. 3B, in the spring portion 13, the bending increases and decreases at two places of the first extension portion 131 and the second extension portion 132, and the first hook portion 151 and the second hook portion 152 move substantially perpendicular with respect to the component mounting surface of the first member 91. Thus, relative to the case where a structure that is equivalent to the first hook portion 151 and the second hook portion 152 moves in the front-and-rear direction also considerably, it is possible to reduce the dimension in the front-and-rear direction of the contact member 1.

In the first embodiment, even when external force acts on the spring portion 13, because the first hook portion 151, the first sidewall portion 171, the second hook portion 152, and the second sidewall portion 172 are provided, the displacement of the third extension portion 133 is restrained. As a result, it is possible to restrain unexpected deformation from arising in the spring portion 13. In addition, because the first hook portion 151 and the second hook portion 152 are provided on the third extension portion 133 structured as in the foregoing, it is possible to arrange the first hook portion 151 and the second hook portion 152 at positions, in the z-axis direction, further on the lower side relative to the second extension portion 132 on which the sucked surface 23 is provided. As a result, it is possible to arrange the upper ends of the first sidewall portion 171 and the second sidewall portion 172 further on the lower side relative to the technique described in JP-5124789 for which hook portions are arranged at the same height as a portion on which the sucked surface 23 is provided. Thus, it is possible to reduce the possibility that, when the suction nozzle of the automatic mounting machine attracts the sucked surface 23, the tip of the suction nozzle catches on the upper ends of the first sidewall portion 171 and the second sidewall portion 172 than in the case where the upper ends of the first sidewall portion 171 and the second sidewall portion 172 are arranged further on the upper side.

In the first embodiment, as shown in FIG. 4A and FIG. 4B, when the third extension portion 133 is displaced obliquely rearward toward the upper side as external force acts on the spring portion 13, the first hook portion 151 and the second hook portion 152 come into contact with the first sidewall portion 171 and the second sidewall portion 172 on the respective end face sides of the sheet that constitutes them. As a result, the first hook portion 151 and the second hook portion 152 are not likely to be bent relative to the case where the first hook portion 151 and the second hook portion 152 come into contact with the first sidewall portion 171 and the second sidewall portion 172 on one sheet surface side of either the front or rear of the sheet. Thus, by the amount that the first hook portion 151 and the second hook portion 152 are not likely to be bent, it is possible to make the sheet thickness thinner and that contributes to downsizing of the contact member 1.

In addition, in the first embodiment, as shown in FIG. 5A and FIG. 5B, when the fourth extension portion 134 is inclined as external force acts on the spring portion 13, the first hook portion 151 comes into contact with the first sidewall portion 171 at an end portion located obliquely rearward toward the upper side. As a result, the first hook portion 151 and the second hook portion 152 are not likely to be bent relative to the case where the first hook portion 151 and the second hook portion 152 come into contact with the first sidewall portion 171 and the second sidewall portion 172 on one sheet surface side of either the front or rear of the sheet. Thus, by the amount that the first hook portion 151 and the second hook portion 152 are not likely to be bent, it is possible to make the sheet thickness thinner and that contributes to downsizing of the contact member 1.

In the first embodiment, the contact portion 12 comes into contact with the second member 92 at the outer circumferential surface of the portion where the sheet has been bent. Thus, even if the contact portion 12 is slightly displaced in a direction accompanying a slight rotation when the spring portion 13 is deformed, it is possible to maintain a state where the contact portion 12 is in contact with the second member 92 at the bent outer circumferential surface, and it is possible to stably maintain the state of electrical connection between the contact portion 12 and the second member 92.

In addition, in the first embodiment, the contact portion 12 and the second extension portion 132 are arranged at positions not overlapping in the y-axis direction (front-and-rear direction) when viewed from above. As a result, unlike the case where the contact portion 12 and the second extension portion 132 are arranged at overlapping positions in the y-axis direction, it is possible to effectively use the entire upper surface of the second extension portion 132 as the sucked surface 23. Thus, because the size of the second extension portion 132 can be minimized for ensuring the sucked surface 23 of a predetermined dimension, relative to the case where the contact portion 12 and the second extension portion 132 are arranged at overlapping positions in the y-axis direction, it is possible to downsize the second extension portion 132, and consequently, it is possible to downsize the entire contact member 1.

(2) Second Embodiment

Next, a second embodiment will be described. Because the second embodiment is only a partial change of the structure illustrated in the first embodiment, it will be described in detail with a focus on the differences from the first embodiment. As for the portions the same as those of the first embodiment, the common reference signs will be given, and their detailed description will be omitted.

As shown in FIG. 6A, FIG. 6B, FIG. 7A, FIG. 7B, FIG. 7C, FIG. 7D, FIG. 7E, and FIG. 7F, a contact member 31 is provided with the base portion 11, the contact portion 12, the spring portion 13, the first hook portion 151, the second hook portion 152, a first sidewall portion 371, and a second sidewall portion 372. In the second embodiment, the shapes of the first sidewall portion 371 and the second sidewall portion 372 are different from those of the first sidewall portion 171 and the second sidewall portion 172 illustrated in the first embodiment. Specifically, in the first embodiment, the first sidewall portion 171 has been provided with the first opening 251, the second sidewall portion 172 has been provided with the second opening 252, and the shapes of the first sidewall portion 171 and the second sidewall portion 172 have been structured in a reversed U-shape. Meanwhile, in the second embodiment, the shapes of the first sidewall portion 371 and the second sidewall portion 372 are structured in a reversed L-shape.

In other words, in the first embodiment, the first sidewall portion 171 and the second sidewall portion 172 have had portions that restrain the first hook portion 151 and the second hook portion 152 from being excessively displaced toward the upper side, portions that restrain the first hook portion 151 and the second hook portion 152 from being excessively displaced toward the rear side, and portions that restrain the first hook portion 151 and the second hook portion 152 from being excessively displaced toward the front side. Meanwhile, in the second embodiment, although the first sidewall portion 371 and the second sidewall portion 372 have portions that restrain the first hook portion 151 and the second hook portion 152 from being excessively displaced toward the upper side and the portions that restrain the first hook portion 151 and the second hook portion 152 from being excessively displaced toward the rear side, the portions that restrain the first hook portion 151 and the second hook portion 152 from being excessively displaced toward the front side are omitted.

Thus, it is preferable that the contact member 1 of the first embodiment be used in the case where a function to restrain the first hook portion 151 and the second hook portion 152 from being excessively displaced toward the front side is needed, but when such a function is not needed, the contact member 31 of the second embodiment may be used. If it is the contact member 31 of the second embodiment, it becomes more lightweight than the contact member 1 of the first embodiment, thereby enabling it to contribute to achieving weight saving of the device. In the points other than the foregoing differences, the contact member 31 of the second embodiment has operation and effect exactly the same as those of the contact member 1 of the first embodiment.

(3) Other Embodiments

As in the foregoing, the contact member has been described with the illustrative embodiments, but the foregoing embodiments have merely been illustrated as one aspect of the present disclosure. That is, the present disclosure is not intended to be limited to the illustrative embodiments shown above, and can be implemented in various forms without departing from the technical idea of the present disclosure.

For example, in the embodiments shown above, two specific shapes of the first sidewall portion and the second sidewall portion have been illustrated. However, the first sidewall portion and the second sidewall portion for which the shapes of details further differ may be provided, and the shapes of the first sidewall portion and the second sidewall portion are not limited to the two examples shown above.

In the embodiments shown above, a beryllium copper sheet of 0.1 mm thickness has been illustrated, as an example of the sheet metal. However, the metal may be other than beryllium copper and the thickness of the sheet may be other than 0.1 mm.

REFERENCE SIGNS LIST

1, 31 CONTACT MEMBER
131 FIRST EXTENSION PORTION
132 SECOND EXTENSION PORTION
133 THIRD EXTENSION PORTION
134 FOURTH EXTENSION PORTION
151 FIRST HOOK PORTION
152 SECOND HOOK PORTION
171, 371 FIRST SIDEWALL PORTION
172, 372 SECOND SIDEWALL PORTION
21 JOINING SURFACE
23 ADSORPTION SURFACE
251 FIRST OPENING
252 SECOND OPENING

What is claimed is:

1. A contact member made up of sheet metal and structured to electrically connect a first member and a second member when surface-mounted on the first member and sandwiched between the first member and the second member, the contact member comprising:

a base portion having a joining surface that is soldered to the first member when the contact member is used;

a contact portion that comes into contact with the second member when the contact member is used;

a spring portion that extends from one end of the base portion, is provided with the contact portion on a distal end side in an extension direction thereof, and makes the contact portion pressure-contact with the second member by elastically deforming when the contact portion comes into contact with the second member, wherein by defining, in a three-dimensional Cartesian coordinate system, an x-axis positive direction is a right side, an x-axis negative direction is a left side, a y-axis positive direction is a rear side, a y-axis negative direction is a front side, a z-axis positive direction is an upper side, and a z-axis negative direction is a lower side, and in a state where the joining surface is directed toward the lower side and the one end of the base portion is directed toward the rear side, the spring portion includes a first extension portion that is bent from a rear end of the base portion and extends toward the upper side, a second extension portion that is bent from an upper end of the first extension portion and extends toward the front side, and for which an upper surface is made to be a sucked surface that is capable of being attracted to a suction nozzle of an automatic mounting machine, a third extension portion that is bent from a front end of the second extension portion and extends obliquely downward toward the front side, and a fourth extension portion that is bent from a front end of the third extension portion, extends obliquely rearward toward the upper side, and is provided with the contact portion on a distal end side in an extension direction thereof;

a first hook portion that projects toward the left side from the third extension portion;

a second hook portion that projects toward the right side from the third extension portion;

a first sidewall portion that is bent from a left end of the base portion and extends toward the upper side;

a second sidewall portion that is bent from a right end of the base portion and extends toward the upper side;

a first opening provided in the first sidewall portion; and a second opening provided in the second sidewall portion, wherein the first hook portion penetrates the first opening, and the second hook portion penetrates the second opening, and the contact member is structured, when the third extension portion is displaced as external force acts on the spring portion, such that displacement of the third extension portion is restrained by establishment of at least one of states out of a state where the first hook portion comes into contact with the first sidewall portion and a state where the second hook portion comes into contact with the second sidewall portion.

2. The contact member according to claim 1, wherein the contact member is structured, when the third extension portion is displaced obliquely rearward toward the upper side as external force acts on the spring portion, such that displacement of the third extension portion obliquely rearward toward the upper side is restrained by establishment of at least one of states out of a state where the first hook portion comes into contact with the first sidewall portion on an end face side of the sheet and a state where the second hook portion comes into contact with the second sidewall portion on an end face side of the sheet.

3. The contact member according to claim 1, wherein the contact portion is bent from an upper end of the fourth extension portion toward the rear side and extends toward the lower side, and is structured to come into contact with the second member at an outer circumferential surface of a bent portion thereof.

4. The contact member according to claim 2, wherein the contact portion is bent from an upper end of the fourth extension portion toward the rear side and extends toward the lower side, and is structured to come into contact with the second member at an outer circumferential surface of a bent portion thereof.

5. The contact member according to claim 1, wherein the contact portion is provided at a position on the front side relative to the second extension portion in the y-axis direction.

6. The contact member according to claim 2, wherein the contact portion is provided at a position on the front side relative to the second extension portion in the y-axis direction.

7. The contact member according to claim 3, wherein the contact portion is provided at a position on the front side relative to the second extension portion in the y-axis direction.

8. The contact member according to claim 4, wherein the contact portion is provided at a position on the front side relative to the second extension portion in the y-axis direction.

* * * * *